United States Patent [19]

Beckett et al.

[11] Patent Number: 5,039,364

[45] Date of Patent: Aug. 13, 1991

[54] METHOD OF MAKING SELECTIVE MICROWAVE HEATING MATERIAL

[75] Inventors: D. Gregory Beckett; Robert Watts, both of Mississauga, Canada

[73] Assignee: Beckett Industries Inc., Oakville, Canada

[21] Appl. No.: 442,155

[22] Filed: Nov. 28, 1989

[30] Foreign Application Priority Data

Nov. 28, 1988 [GB] United Kingdom ..... 8827759.5

[51] Int. Cl.[5] ..... B31F 1/00

[52] U.S. Cl. ..... 156/60; 156/224; 219/10.55 E; 426/107; 427/50; 427/124; 427/250; 427/259; 427/270; 427/404; 427/416

[58] Field of Search ..... 219/10.55 E; 426/107; 427/259, 296, 124, 250, 257, 273, 270, 416, 404, 50, 99; 156/233, 224, 60

[56] References Cited

U.S. PATENT DOCUMENTS

| | | | |
|---|---|---|---|
| 4,230,924 | 10/1980 | Brastad et al. | 426/107 |
| 4,398,994 | 8/1983 | Beckett | 156/635 |
| 4,431,711 | 2/1984 | Eisfeller | 427/296 |
| 4,641,005 | 2/1987 | Seiferth | 156/233 |
| 4,676,857 | 6/1987 | Scharr | 156/233 |
| 4,865,921 | 9/1989 | Hollenberg | 428/107 |
| 4,883,936 | 11/1989 | Maynard | 219/10.55 E |
| 4,962,000 | 10/1990 | Emslander | 426/107 X |
| 4,962,293 | 10/1990 | Lackey | 426/107 X |

OTHER PUBLICATIONS

Powell, C. F., et al., ed., *Vapor Deposition,* 1972, pp. 126–132.

Incropera, F. P., et al., *Fundamentals Of Heat Transfer,* John Wiley & Sons, 1981, pp. 482–483.

*Primary Examiner*—David A. Simmons
*Assistant Examiner*—Chester T. Barry
*Attorney, Agent, or Firm*—Sim & McBurney

[57] ABSTRACT

A method is described for achieving selective generation of thermal energy from a thin metal film upon exposure to microwave energy. A deactivating material is first applied to a substrate from the thin metal film in a pattern corresponding to the region from which heat is not to be generated. The metal then is applied over the substrate and the pattern in a thickness which normally generates thermal energy upon exposure to microwave energy. Such thermal energy is produced only from those regions where the metal is adhered directly to the substrate.

9 Claims, No Drawings

METHOD OF MAKING SELECTIVE MICROWAVE HEATING MATERIAL

FIELD OF INVENTION

The present invention relates to the production of microwave heating material.

BACKGROUND TO THE INVENTION

It is well known that thin metallic films can be used to convert a portion of microwave energy incident thereon to thermal energy and that such thermal energy may be used to crispen and brown foodstuff heated by microwave energy, as described, for example, in U.S. Pat. No. 4,641,005. The metal most commonly used is aluminum.

Aluminized polymeric substrate films having the required thickness of aluminum thereon are commercially available. It is often desirable, when such films are used for the generation of thermal energy, for the metal to be located only on a portion of the substrate surface.

There have previously described procedures for effecting selective demetallization of the substrate by etching away metal from the undesired regions of the polymeric film substrate. These procedures are described in U.S. Pat. Nos. 4,398,994, 4,552,614, 4,610,755 and 4,685,997, the disclosures of which are incorporated herein by reference. By removing metal from selected portions of the polymeric substrate, thermal energy is generated only from the remaining adhered metal.

SUMMARY OF INVENTION

In accordance with the present invention, there is provided a novel procedure for producing a microwave heating material which converts microwave energy to thermal energy from selected portions only of the surface thereof which does not require the prior art demetallization procedures.

Accordingly, in one aspect of the present invention, there is provided a novel method of providing a product capable of producing thermal energy from a portion only of the surface thereof upon the application of microwave energy thereto.

The term "producing thermal energy" or "generating thermal energy" means "converting microwave energy to thermal energy". Mere conductive transfer of thermal energy without the aforementioned energy conversion step does not constitute thermal energy "production" or "generation" in the sense intended here.

A substrate of dielectric material is provided capable of supporting a thin film of electroconductive material thereon. A desired pattern of a deactivating material which, when the electroconductive material is positioned thereon, inhibits the generation of heat therefrom when exposed to microwave energy, is applied to the substrate.

A thin film of electroconductive material is applied to the substrate and the pattern thereon of a thickness effective normally to produce thermal energy when exposed to microwave radiation. The resulting product is capable of producing thermal energy from the electroconductive material in those regions of the substrate where the electroconductive material is directly supported thereon and thermal energy is not produced from the electroconductive material in those regions of the substrate bearing the pattern of material.

The present invention also includes the product of this method, which may be incorporated into a variety of packaging structures for use in the microwave cooking of foodstuff.

GENERAL DESCRIPTION OF INVENTION

A key feature of the present invention is the utilization of a material which results in inhibition of the generation of thermal energy from a thin metal film thereon which would normally produce such thermal energy.

The material is applied to the substrate of microwave-energy wave transparent dielectric material in a pattern corresponding to the portions of the surface of the substrate from which thermal energy is not desired to be generated, in analogous manner to the desired pattern of demetallization in the prior art, but without the necessity for demetallization. The substrate may comprise paper or paperboard, preferably with a smooth surface, or more usually is a polymeric film. Any polymeric material which is heat stable under conditions of lamination and use may be employed, such as polyester and polyolefin materials.

The deactivating material may be provided by a variety of substances, such as those having a high surface tension, for example, a high surface tension wax material. Materials having a rough surface also may be employed, such as a dried caustic soda solution.

The metal does not heat up in the regions overlying the wax because the wax provides, on a microscale, a very uneven surface which does not permit the microwave energy to become converted to thermal energy. Accordingly, any other non-smooth surfaced material or other material producing an equivalent effect may be used in place of the wax. The wax coating appears to cause the metal to be deposited in tiny islands which are spaced apart a distance such that microwave energy conversion to thermal energy is not possible. This appears to be a surface tension effect, so that any similar high surface tension material may be employed. However, the thin metal film directly adhering to a polymeric film or other smooth substrate surface converts a portion of microwave energy incident thereon to thermal energy.

As mentioned above, one possible deactivating material is aqueous caustic soda solution which is permitted to dry on the polymeric film substrate before metallization of the substrate. The use of caustic soda solution or other etchant for the metal layer in this way also permits the metal not just to be deactivated but also to be removed completely from those portions of the substrate to which the etchant is applied, which may be desirable in certain applications.

In the latter embodiment, the aqueous solution of etchant is applied to the substrate in the pattern desired to be removed. After the etchant has dried, the substrate is metallized to provide metal of the desired thickness over the whole of the surface. The simple application of wash water, in any convenient manner, then results in removal of the metal from the polymeric film substrate in the pattern of the etchant.

The pattern of deactivating material, such as wax applied to the substrate may take any desired shape and form consistent with the intended end use of the product. A thin layer of suitable wax or other material is applied to the substrate by any convenient means, such as by printing, and preferably as a repeating pattern on a smooth paper or polymeric film substrate in a continuous operation. The substrate then is coated over its whole surface, including the pattern, by the electroconductive material to the desired thickness. The manner of application of the electroconductive material depends on the material chosen.

In a continuous operation, the coating step preferably is effected by conventional vapour deposition of a metal, usually aluminum, on a polymeric film substrate, with the thickness of the coating being determined by the residence time of the polymeric film in the vapour deposition chamber. Vapour deposition produces a thin adherent film of the metal over the whole of the surface of the polymeric substrate, including the regions where the wax pattern was first applied.

The electroconductive material usually is provided by aluminum, although other electroconductive metals such as stainless steel and copper, may be used. Other electroconductive materials, such as carbon, also may be employed.

It is most convenient when aluminum is employed as the electroconductive material for the aluminum to be applied to a polymeric material substrate by vapour deposition, as described above. However, stainless steel is more conveniently applied by sputtering and the substrate layer may be smooth-surfaced paper in place of polymeric film, if desired.

The thickness of the electroconductive material applied to the substrate should be that which normally results in the conversion of a portion of microwave energy incident thereon to thermal energy. The actual thickness of electroconductive material required depends on the electroconductive material chosen.

For aluminum metal, the metal generally has a thickness corresponding to an optical density of about 0.08 to about 2.0, preferably about 0.1 to about 0.8, typically about 0.2 to about 0.3.

For polymeric film substrate, there is a tendency for the substrate to distort when heated, which causes the product to lose its effectiveness for converting microwave energy to thermal energy. Accordingly, it is generally necessary to laminate the polymeric material, usually after coating with metal, to at least one layer, preferably sandwiched between two such layers, of relatively stiff paper or card, using conventional laminating procedures.

The relatively stiff layers prevent the polymeric film layer from distorting and, thereby, the laminate is able to retain its effectiveness in converting microwave energy to thermal energy in those regions where the metal does not overlie the deactivating material.

The product of the invention has utility in a variety of microwave heating operations, wherein the product is incorporated into a package, for example, in the microwave popping of corn, and in the microwave reheating of food products, such as pizzas and french fries. The deactivation of the metal in the regions of the deactivating material enable heat seals to be made at these locations without the danger of heating at the seals as the results of the thin metal layer there.

In summary of this disclosure, the present invention provides novel and effective manner of achieving a product which selectively generates thermal energy from microwave radiation without the necessity for selective demetallization of the metal susceptor layer. Modifications are possible within the scope of this invention.

What is claimed is:

1. A method of making a product capable of converting microwave energy to thermal energy from a portion only of the surface thereof upon the application of microwave energy thereto, which comprises:

providing a substrate of dielectric material which is capable of supporting a thin film of electroconductive metal thereon, wherein said film is sufficiently thin to produce thermal energy when exposed to microwave energy, applying in a desired pattern to a surface of said substrate a deactivating material which, when said electroconductive metal is subsequently positioned thereon, inhibits the generation of heat from said electroconductive metal when exposed to microwave energy, said deactivating material being an aqueous solution of sodium hydroxide which is dried to provide a rough surface on said substrate in said desired pattern prior to subsequent application of said electroconductive metal thereto, and applying to said surface of said substrate bearing said pattern a thin film of an electroconductive metal of a thickness effective to produce thermal energy when exposed to microwave radiation and not in contact with said deactivating material, whereby the resulting product is capable of producing thermal energy from said electroconductive metal in those regions of said substrate where said electroconductive metal is directly supported thereon and thermal energy is not produced from said electroconductive metal in those regions of said substrate bearing said pattern of material.

2. A method making a product capable of converting microwave energy to thermal energy from a portion only of the surface thereof upon the application of microwave energy thereto, which comprises:

providing a substrate of dielectric material which is capable of supporting a thin film of electroconductive metal thereon, wherein said film is sufficiently thin to produce thermal energy when exposed to microwave energy, applying in a desired pattern to a surface of said substrate a deactivating material which, when said electroconductive metal is subsequently positioned thereon, inhibits the generation of heat from said electroconductive metal when exposed to microwave energy, said deactivating material being a high surface tension material having a surface tension sufficiently high as to cause electroconductive metal applied thereto to be deposited in the form of tine islands which are spaced apart a distance such that microwave energy conversion to thermal energy is not possible, and applying to said surface of said substrate bearing said pattern a thin film of an electroconductive metal of a thickness effective to produce thermal energy when exposed to microwave radiation and not in contact with said deactivating material, whereby the resulting product is capable of producing thermal energy from said electroconductive metal in those regions of said substrate where said electroconductive metal is directly supported thereon and thermal energy is not produced from said electroconductive metal in those regions of said substrate bearing said pattern.

3. A method of making a product capable of converting microwave energy to thermal energy from a portion only of the surface thereof upon the application of microwave energy thereto, which comprises:

providing a substrate of dielectric material which is capable of supporting a thin film of electroconductive metal thereon, wherein said film is sufficiently thin to produce thermal energy when exposed to microwave energy, applying in a desired pattern to a surface of said substrate a deactivating metal which, when said electroconductive material is subsequently positioned thereon, inhibits the generation of heat from said electroconductive metal when exposed to microwave energy, said deactivating material being a high surface tension wax having a surface tension sufficiently high as to cause electroconductive metal applied thereto to be deposited in the form of tiny islands which are spaced apart a distance such that microwave energy conversion to thermal energy is not possible, and applying to said surface of said substrate bearing said pattern a thin film of an electroconductive metal of a thickness effective to produce thermal energy when exposed to microwave radiation and not in contact with said deactivating material, whereby the resulting product is capable of producing thermal energy from said electroconductive metal in those regions of said substrate where said electroconductive metal is directly supported thereon and thermal energy is not produced from said electroconductive metal in those regions of said substrate bearing said pattern.

4. The method of claim 1 wherein said thin metal layer is removed from the patterned region of the substrate by the application of wash water.

5. The method of claim 3 wherein said thin film of an electroconductive metal is a thin film of aluminum having an optical density of about 0.08 to about 2.0.

6. The method of claim 5 wherein said optical density is about 0.1 to about 0.08.

7. The method of claim 3 wherein said substrate is a flexible polymeric film and further comprising laminating said resulting product to at least one layer of relatively stiff paper to inhibit distortion of the polymeric film when the resulting laminate is subjected to microwave radiation.

8. The method of claim 7 wherein said flexible polymeric film is laminated between two outer layers of relatively stiff paper.

9. The method of claim 7 further comprising forming the resulting lamination into a packaging structure.

* * * * *